United States Patent [19]

Chrisler, deceased et al.

[11] 4,202,047

[45] May 6, 1980

[54] ACOUSTIC JAMMER AND TORPEDO DECOY

[75] Inventors: Vivian L. Chrisler, deceased, late of Vienna, Va., by Cecelia B. Chrisler, executrix; William H. Gilbert, Hyattsville; George L. Boyer, Rockville, both of Md.

[73] Assignee: The United States of America as represented by the Secretary of the Navy, Washington, D.C.

[21] Appl. No.: 339,498

[22] Filed: Feb. 27, 1953

[51] Int. Cl.[2] ..... H04K 3/00

[52] U.S. Cl. ..... 367/1; 116/27; 181/142

[58] Field of Search ..... 340/5, 8, 112, 5 D; 181/0.51, 142; 116/27, 22

[56] References Cited

U.S. PATENT DOCUMENTS

| | | | |
|---|---|---|---|
| 311,255 | 1/1885 | Pedersen | 74/785 |
| 935,750 | 10/1909 | Gale | 340/12 |
| 1,292,755 | 1/1919 | Geraghty | 340/2 |
| 2,395,862 | 3/1946 | Freeman | 181/0.5 |
| 2,548,905 | 4/1951 | Odenweller et al. | 116/27 |

*Primary Examiner*—Richard Farley

*Attorney, Agent, or Firm*—R. S. Sciascia; Q. E. Hodges

EXEMPLARY CLAIM

1. An acoustic decoy adapted to operate underwater, said decoy comprising a motor means, a circular spindle means connected to said motor means and adapted to be rotated thereby, said spindle means having a pair of axially aligned spaced parallel discs, a plurality of radially extending sockets formed in the periphery of each disc with the sockets of respective discs being in axial alignment with each other, a roller comprising a shaft slidably and loosely supported within each pair of aligned sockets, each of said rollers comprising a pair of hammers on the associated shaft, and a casing means surrounding said spindle means, on the sides and one end thereof, said casing means comprising a cylindrical casing concentric with the axis of rotation of said spindle means, said sockets terminating radially inwardly from said casing a distance sufficient to receive the associated shaft with its hammers spaced from said casing when said spindle means is not rotating, whereby said hammers are moved by centrifugal force to impinge against the sides of said casing whenever the spindle is rotated.

6 Claims, 5 Drawing Figures

ACOUSTIC JAMMER AND TORPEDO DECOY

The invention described herein may be manufactured and used by or for the Government of the United States of America for Governmental purposes without the payment of any royalities thereon or therefor.

The present invention relates to a buoyant acoustic system and more particularly to an expendable underwater noisemaker operating as a decoy.

Modern high-speed ships generally produce noises which are transmitted through the water for long distances and cover a wide range of frequencies. Hydrophone detection of ships and submarines, through such noises, has long been employed by the navies of the world, while homing acoustic torpedoes and mines employed during the last world war, following such noises, sank increasing numbers of ships. Because it is generally difficult if not impossible to greatly reduce the noise radiated by a ship, other means must be found to confuse an enemy and his homing weapons. One method of accomplishing this deception is to employ noisemakers which produce noises louder than those of the ship at a point remote therefrom and since homing weapons are constructed to direct themselves towards the loudest source of noise, they may by-pass the real target for the noisemaker.

To accomplish the task of deception, the acoustic apparatus, i.e. noisemaker, must operate to produce sound over a broad band of frequencies and at an intensity greater than that produced by the ship seeking refuge. In so doing, the noisemaker will mask the vessel from hostile acoustic apparatus. The production of noises having such sound intensities and broad frequency coverage presents serious design difficulties since the apparatus operates at a remote point independently of the launching vessel and is restricted in size for convenience in launching and to escape enemy detection.

Sound is best created by mechanical vibration but to create sound of large intensities, a heavy and constant vibration is needed. With the limited power source and space of an isolated acoustic apparatus, a small but efficient noisemaker sturdily constructed to withstand the heavy and constant vibration is needed. Furthermore, experience has shown that it is necessary at times to selectively adjust the time of initiating operation of the acoustical equipment after ejection from the fleeing ship to avoid initial detection such as when an enemy vessel approaches a submarine whose exact location has not as yet been determined, or for the simultaneous ejection of a plurality of units where only one is to operate at a time. By providing a time delay in the initial operation, the noisemaker may be ejected from the submarine and prevented from operating until a predetermined time interval has expired, whence the submarine may travel to a location several hundred yards from the noisemaker before the noisemaker begins its operation.

Accordingly, it is an object of the present invention to provide a noisemaker producing sound over a broad band of frequencies.

Another object of the invention is to provide a noisemaker producing sound of high intensity.

A further object is to provide an efficient and sturdily constructed acoustical apparatus for underwater operation.

Still another object of the invention is to provide an adjustable time-delay in the initial operation of the noisemaker.

With these and other objects in view, as will hereinafter more fully appear, and which will be more particularly pointed out in the appended claims, reference is now made to the following description taken in connection with the accompanying drawings, in which like or corresponding parts are indicated by the same reference character and in which:

It is frequently desirable to position the acoustic equipment in the water and to launch such equipment from either surface ships or from a submerged submarine. In ejecting a buoyancy system from a depth of several hundred feet in water, the buoyancy system is subjected to very high pressure which may cause improper operation thereof or destroy the device entirely and since it is usually desirable to position the equipment near the surface of the water, the system must operate to elevate the equipment to the surface. To facilitate launching and to protect the device while in dry storage, the entire assembly is packed in a protective two part cylindrical container having a diameter of approximately three inches such that it is adapted to be ejected from the flare tube of a submarine. The cylindrical container comprises an upper compartment 14 containing a packed buoyancy system and a power supply and a lower compartment 16 containing the acoustic apparatus to be suspended in the water from the buoyancy system. Upon ejection of the unit from a subsurface vessel, a delayed action device (not shown) produces a longitudinal force in a manner as to separate the two sections of the container and expose the buoyancy system to the water. A delay of approximately four seconds is used to insure that the container is free of the vessel's ejecting mechanism before the sections of the container are separated.

Figure 2:
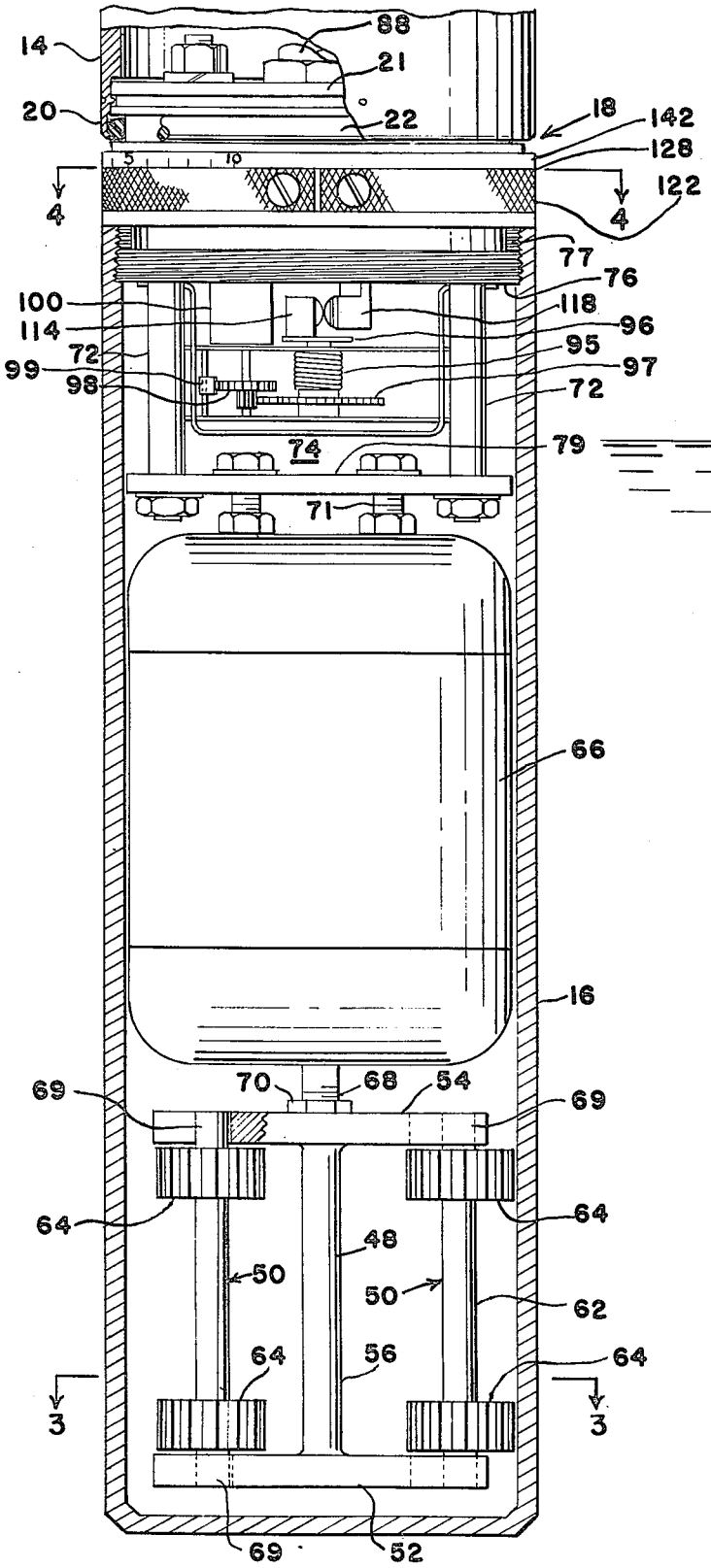
FIG. 2 is an elevation view of the operational features of the noisemaker with the noisemaker cylinder and other features in section.

Referring specifically to the drawings and as best seen in FIG. 2, which is generally not to scale, the upper compartment 14 is provided with a reduced portion 20 on its extreme lower end which is adapted to receive an upper reduced portion 21 of a compartment separator 18. A groove 22 is located upon the periphery of the reduced portion 21 and is adapted to receive a sealing means such as an O-ring of natural or synthetic resilient material. The lower end of the upper compartment 14 is fitted over the O-ring and crimped to form a water-tight fit therebetween. The attachment is such that the upper compartment 14 comprises an outer cover that is securely fastened to the separator 18 under conditions of ordinary handling but separates from the separator 18 by an axial force applied thereto.

Figure 1:
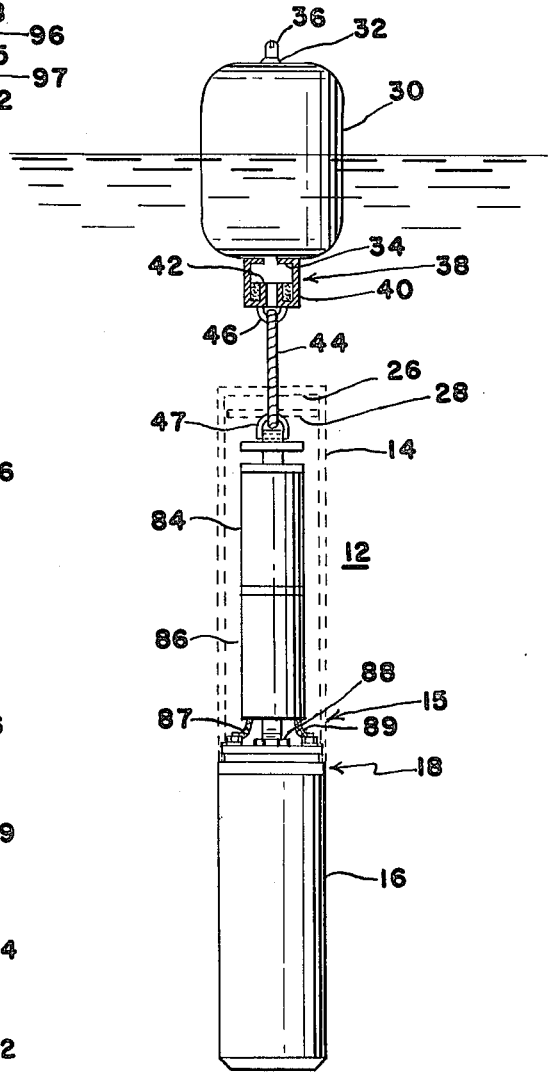
FIG. 1 is an elevation view of the present invention in operation and showing portions of the original container in dotted form.

There is shown in FIG. 1 the noisemaking unit 12 positioned in an underwater operating position and consisting of a noisemaker indicated in its entirety by the reference numeral 15 and suspended below a buoyancy system. The buoyancy system includes an envelope or balloon 30 constructed of flexible impervious material of any desired shape, but is illustrated as cylindrical with rounded edges. Couplings 32 and 34 are sealed into the upper and lower ends of the balloon respectively with a valve cap 36 attached to the coupling 32 and a gas generator 38 secured to the coupling 34. The gas generator 38 may be of any desired type, the major requirement being that it be of light weight and provides a substantially constant emission of gas over a period of time. The gas generator as seen in FIG. 1 comprises an outer cup 40 and a vent tube 42 extending through the cup to a point near the top of the cup. Within the cup and surrounding the vent tube is inserted a suitable chemical, such as lithium hydride, which liberates a gas upon contact with water.

As water enters the cup 40 through the vent tube 42 and contacts the lithium hydride, a chemical reaction begins and produces as a product thereof, hydrogen gas which rises through the water into the balloon 30, to create a pressure therein. As the hydrogen enters the balloon, it forces water from the balloon through the vent tube 42 to increase the buoyancy of the system. The cap 36 secured to the coupling 32 may be, for example, an ordinary auto tire valve cap with an open orifice therein of a predetermined size, the size being determined by the rate at which it is desired to allow gas to continuously escape from the balloon and which rate determines the volume of gas in the balloon and therefore the buoyancy of the system. Hence, by varying the size of the orifice and the amount of lithium hydride contained in the cup 40, the depth at which the acoustical apparatus will be suspended in the water and the duration of such suspension may be controlled. When the chemical has been completely expended, gas is no longer generated with the result that the remaining gas leaks from the balloon 30, through the valve 36, until a negative buoyancy is assumed and the unit sinks to the bottom of the sea, safe from the hands of the enemy.

The noisemaker 15 is supported from the buoyancy system by suitable means such as line 44 attached to the buoyancy system and to the noisemaker by tie rings 46 and 47 secured by suitable means to the gas generator and the noisemaker respectively.

The noisemaking apparatus is encased within the noisemaker cylinder 16 which supports the contained equipment, seals the unit from water, and radiates sound energy generated thereby. The noise is produced by creating mechanical vibrations in the noisemaker cylinder 16 by means of a spindle 48 and a plurality of rollers 50 loosely carried thereby and adapted to engage the inner surface of the cylinder 16. The contact made by the rollers against the inner walls of the cylinder create intense vibrations in the noisemaker cylinder 16 which vibrations generate and transmit high intensity sound waves over a wide band of frequencies into the surrounding medium.

Figure 3:
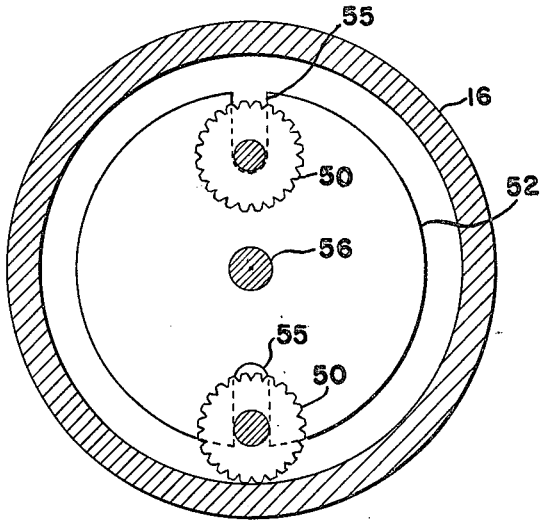
FIG. 3 is a cross-sectional view of the noisemaker taken on the line 3—3 of FIG. 2 and showing specific features of the invention.

As shown in FIGS. 2 and 3, the spindle 48 is a unitary member fitted adjacent the lowermost portion of the noisemaker cylinder. Spindle 48 comprises a pair of axially aligned, parallel support spiders or discs 52 and 54, permanently joined at their centers by an axial, elongated spacer 56 and having diameters slightly smaller than the cylinder 16. The unitary construction of the spindle 48 enables the member to withstand heavy vibrational forces necessarily applied thereto by the rollers 50 during operation. Each of the support discs 52 and 54 has, on diametrically opposed portions of its periphery, a pair of recessed sockets 55 extending radially inwardly toward the spacer 56. The sockets of disc 52 are axially aligned with those of disc 54.

Slidably and rotatably mounted within each pair of aligned sockets 55 is a unitary noisemaker roller 50 comprising a shaft 62 having near each end thereof a pair of hammers 64 positioned a sufficient distance from the ends of the shaft to provide a journal 69 for supporting the rotatable rollers within the sockets. Hammers 64 in the preferred embodiment are shown as cylindrical in shape with a plurality of longitudinal grooves on the periphery thereof. However, any suitably shaped configuration such as a multiple sided member may be employed. The basic requirement being that it rotate relative to the spindle 48 as the spindle rotates. The spindle 48 is rotated by a motor 66 in the cylinder 16. When the spindle 48 rotates, the roller units will be forced, by centrifugal action, against the inner surface of the cylinder 16 whereby the irregular rollers will continuously impinge or hammer against the surface to mechanically vibrate the cylinder. The number of impingements will be determined by the spindle speed of rotation and the number of projections upon the surface of each hammer. The vibration set up in the cylinder 16 will produce sound waves in the surrounding medium over a broad range of frequencies. The frequency of the sound generated is dependent upon the speed of the rollers and the physical dimensions of the unit including the thickness of the cylinder walls. The acoustical output is varied by the speed of the driven rollers.

It will be appreciated that by mounting the rollers 50 within the recessed slots 55, substantially no load is applied to the driving motor 66 upon movement of the spindle 48 in starting but rather, the load will increase gradually as the speed increases, since the rotational speed will determine the centrifugal force and hence the force with which the rollers will impinge against the cylinder walls. Since the driving motor 66 does not require a heavy starting torque it may be efficiently operated by a small power source. Varying the number of grooves placed upon the periphery of the hammers of the rollers 50 will vary the power loss as well as the amplitude of the signal output; and in order to obtain a high acoustic output with the least power loss due to friction, the rollers are grooved along the periphery with approximately 30 grooves on the periphery of each of the rollers.

It is obvious of course that any suitable type of power means may be employed to drive the spindle of the noisemaker. However, because of the space and weight limitations of the expendable noisemaker, an electric motor 66 positioned intermediate the ends of the noisemaker cylinder is used. The shaft 68 of motor 66 is directly coupled to spindle 56 of the noisemaking apparatus by suitable means which may include a threaded end on motor shaft 68 screwed into a threaded hole formed in spacer 56. A lock nut 70 securely locks the elements together.

Motor 66 is positioned and secured within the noisemaker cylinder 16 by means of a spacer disc 79 and a nut and bolt arrangement 71, spacer disc 79 being in turn securely bolted to separator 18. A plurality of spacer members 72 are interposed between spacer disc 79 and separator 18 for defining a compartment 74 therebetween for a time delay device as hereinafter described.

An internally threaded portion is formed near the upper or open end of noisemaker cylinder 16. This threaded portion is adapted to cooperate with a threaded portion 76 cut on a reduced portion 77 of the lower end of the separator 18 to securely fasten the cylinder and the separator together, whereby the noisemaker apparatus contained in the cylinder 16 is sealed and protected from any water which might otherwise enter the cylinder.

Electric power to operate the motor 66 comprises sea batteries 84 and 86 attached to the upper end of separator 18 by means of a bolt 88 threaded into separator 18. Such batteries, as is well known to those skilled in the art, consist of a spirally wound sheet of pure silver coated with silver chloride and separated from a spirally wound sheet of magnesium by a chemically treated paper. Generally, the batteries are inactive until immersed in sea water; when immersed, a chemical reaction is begun which produces a substantial power output for a period of a few minutes which expends the life of the battery. The cells 84 and 86, which are electrically connected in series, are electrically connected to the motor 66 by leads 87 and 89 (FIG. 1). The battery circuit also includes a time delay circuit as will hereinafter be explained. When the acoustic apparatus 12 is ejected from a vessel and the upper compartment 14 is separated from the lower compartment 16, the batteries will be exposed to sea water whereby the chemical action between its elements will begin. In the embodiment shown, an electrical current of approximately 20 amperes will be produced at a potential of eleven volts for a period of about five minutes.

Figure 5:
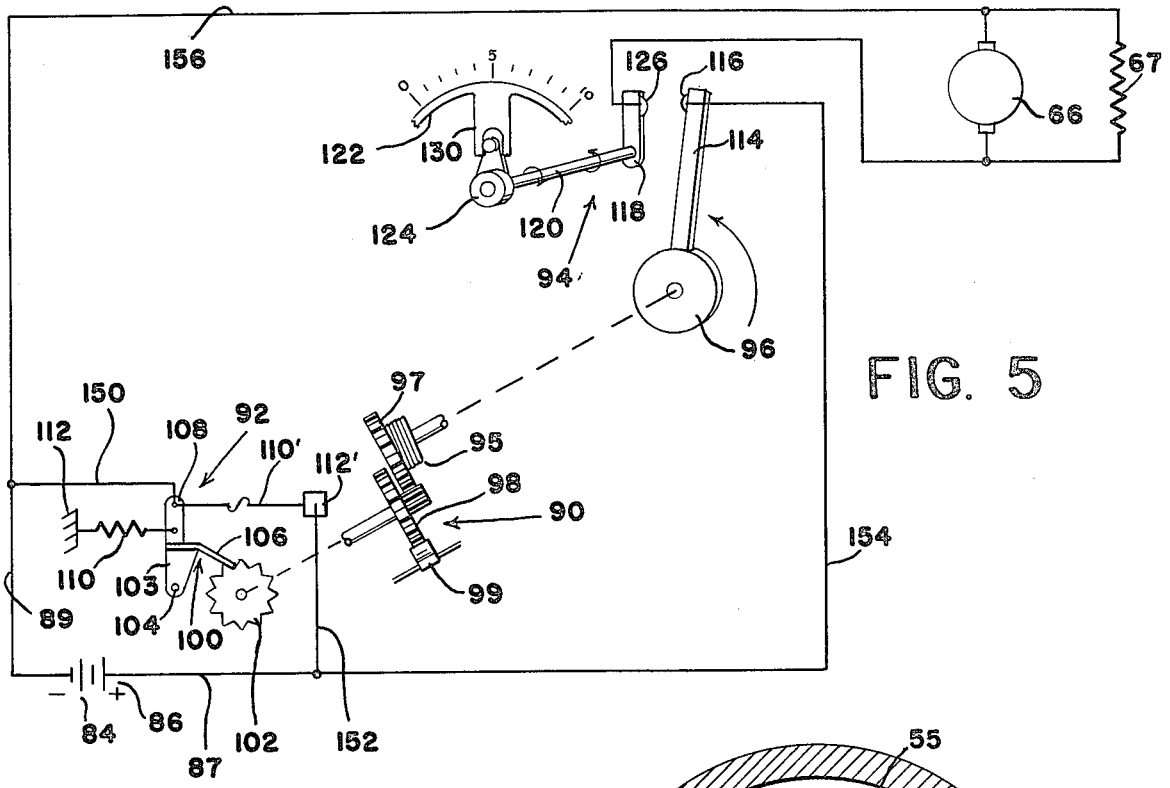
FIG. 5 is a diagrammatical showing of the time delay unit illustrating the cooperation of the electrical and the mechanical components therein.

In order to control the time-operations of the noisemaker after ejection from a vessel, an adjustable timer unit is incorporated into the decoy. As shown in FIGS. 2 and 5, the timer unit comprises a suitably driven gear train and escapement mechanism 90, a latching mechanism 92 and a circuit control means 94 connected in the circuit with the motor 66. The escapement mechanism 90 may comprise any commercial clockwork timer but is shown as including a torque spring 95 rotatably driving, under the control of a series of gears, a contact disc 96. The rotation of the contact disc 96 is retarded from movement by a clock train having gear members 97 and 98, and an escapement pawl 99. Initially, the clock train is prevented from operating by a spring held latch 100 engaging the teeth of an escapement gear 102 secured to gear member 98.

Latch 100 comprises a lowermost portion 103 which is pivoted on a pin 104 secured to a stationary member of the noisemaker and has an extended arm 106 protruding from one end thereof adapted to engage the teeth of escapement gear 102. A tension spring 110, one end of which is secured to the mid portion of an insulated terminal strip 108 of the latch member and the other end attached to a stationary point 112, serves to bias the latch member 100 in a direction away from the escapement gear 102. The latch member 100 is maintained in a latched position against the gear 102 by means of a fuse wire 110' mechanically interconnecting the latch member and the separator 18. The fuse wire 110' is attached at one end to the insulated terminal strip 108 on the latching member 100 and at the other end to the terminal strip 112'.

Figure 4:
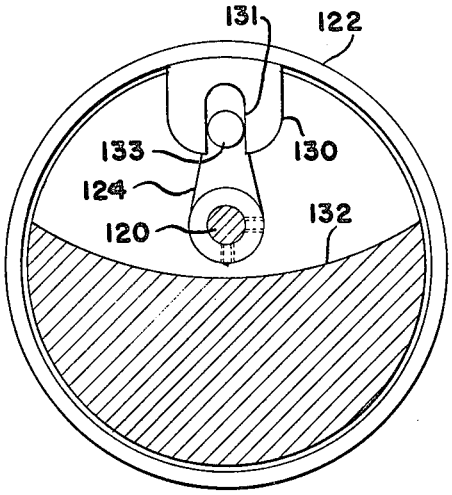
FIG. 4 is a sectional view taken on the line 4—4 of FIG. 2 and showing the adjusting apparatus of the timer.

A contact arm 114 having an insulated electrical contact 116 on the upper end thereof is secured to the rotatable contact disc 96 and adapted to be rotated therewith by the timing mechanism. A second contact arm 118 located in the same plane adjacent the first contact arm 114 is secured to a shaft 120 which in turn is mechanically connected with a setting band 122 through a setting link 124. An insulated electrical contact 126 is supported upon the contact arm 118. As best seen in FIGS. 2 and 4, the setting band 122 comprises a knurled, circular metallic band slidably mounted in a groove 128 provided on the periphery of the separator 18, and a setting fork 130 integral with the band. Setting fork 130 extends radially inward and is provided with a bearing slot 131 adapted to engage a bearing pin 133 secured to the upper portion of the setting link 124.

The setting link 124 and the setting fork 130 are positioned within a sector 132 formed in the upper face of the separator 18 and extending approximately one-half of the depth thereof.

Manual rotation of the setting band 122 rotates the setting link 124 which is rotatably mounted within the bearing slot 131 of the fork 130 so that rotational movement of the setting band gives a circular motion to the fork. The sector 132 is sufficiently large to permit an approximate 180° movement of the setting link. Shaft 120 is secured to the setting fork by suitable means and transmits this rotational movement to the contact arm 118 through the side of the sector 132, a seal being provided by a gland nut (not shown) having O-ring seals thereon. The gland nut and the seals serve to prevent any water from entering the noisemaker cylinder through the opening 132 around the shaft 120.

An indicia plate 142 is placed on the exterior of the cylinder 16 adjacent the setting band 122 with graduations printed thereon reading from zero to ten minutes for convenience in setting the apparatus.

The electrical circuit for the timing mechanism is shown in FIG. 5. The fuse wire 110' which holds the latching member 100 locked is connected to a stationary insulator 112' attached to the separator 18 and the insulated terminal strip 108 of the latch 100. A pair of leads 150 and 152 electrically connect the fuse wire with the terminals of the sea power batteries 84 and 86 through electrical leads 87 and 89. The motor circuit is connected in parallel with the fuse and includes lead line 154 connected to the positive terminal of the power supply through lead 87, rotatable contact 116, settable contact 126, motor 66, lead line 156, and lead line 89 which terminates at the negative terminal of the power supply. Also, a field winding 67 is connected in parallel with the armature of motor 66 in the usual manner.

OPERATION

The noisemaker is prepared for operation by rotating the setting band 122 to the desired time-delay. This rotation varies the distance between contacts 116 and 126 by rotating contact arm 126 through link 124 and shaft 120 and therefore varies the time required for the clockwise 90 to move contact 116 into engagement with contact 126. The noisemaker is then launched from the vessel by suitable apparatus. The cover 14 is forced away from the noisemaker cylinder, thus exposing the gas generator and the sea batteries to the water. Hydrogen generated in the gas generator inflates the balloon and produces a positive buoyancy of the system. Current generated by the sea batteries flows into the latch circuit, melting the fuse wire 110' and releasing the latch 100 which is held under the force of the spring 110, so as to permit the clockwork to commence its operation. After the predetermined time interval, contacts 116 and 126 close to complete the circuit to motor 66. Rotation of the motor will revolve spindle 48 whereby the resultant centrifugal force acting upon rollers 50 will force hammers 64 of the rollers 50 to impinge and rotate against the inner surface of noise-maker cylinder 16 whereupon the cylinder is vibrated to produce a resultant noise having a broad band of frequencies and at a high intensity.

Obviously many modifications and variations of the present invention are possible in the light of the above teachings without departing from the spirit and the scope of the invention as set forth in the appended claims as only a preferred embodiment thereof has been disclosed.

We claim:

1. An acoustic decoy adapted to operate underwater, said decoy comprising a motor means, a circular spindle means connected to said motor means and adapted to be rotated thereby, said spindle means having a pair of axially aligned spaced parallel discs, a plurality of radially extending sockets formed in the periphery of each disc with the sockets of respective discs being in axial alignment with each other, a roller comprising a shaft slidably and loosely supported within each pair of aligned sockets, each of said rollers comprising a pair of hammers on the associated shaft and a casing means surrounding said spindle means on the sides and one end thereof, said casing means comprising a cylindrical casing concentric with the axis of rotation of said spindle means, said sockets terminating radially inwardly from said casing a distance sufficient to receive the associated shaft with its hammers spaced from said casing when said spindle means is not rotating, whereby said hammers are moved by centrifugal force to impinge against the sides of said casing whenever the spindle is rotated.

2. An acoustic decoy for operation under water, comprising a cylindrical casing, a rotatable spindle means, a motor having a shaft to which said spindle means is axially secured, said motor shaft and casing having a common axis, said spindle means comprising a pair of axially-spaced radially-extending members, said members having outwardly-directed axially-aligned peripheral slots, a roller means comprising a shaft slidably and loosely supported in each pair of aligned slots and hammer means on the associated shaft, said slots being of a length such that said hammer means is spaced from said casing when the associated shaft contacts the bottoms of the associated slots which bottoms are nearest said axis, said casing being sufficiently close to said axis to hold said roller means in the associated pair of slots with said hammer means pressing on said casing through the action of centrifugal force on said roller means during rotation of the spindle means.

3. An acoustic decoy as defined in claim 2 but further characterized by said hammer means comprising a pair of cylindrical hammers on the associated shaft.

4. An acoustic decoy as defined in claim 2 but further characterized by said casing having a bottom adjacent said spindle means on the end thereof opposite said motor.

5. An acoustic decoy for operation under water, comprising a cylindrical casing, a rotatable spindle means, an electric motor in said casing having a shaft to which said spindle is axially secured, said motor being the sole support for said spindle means, said motor shaft and casing having a common axis, said spindle means comprising a pair of axially-spaced radially-extending members, said members having outwardly-directed axially-aligned peripheral slots, a roller means comprising a shaft slidably and loosely supported in each pair of aligned slots and hammer means on the associated shaft, said slots being of a length such that said hammer means is spaced from said casing when the associated shaft contacts the bottoms of the associated slots which bottoms are nearest said axis, said casing being sufficiently close to said axis to hold said roller means in the associated pair of slots with said hammer means pressing on said casing through the action of centrifugal force during rotation of said spindle means.

6. An acoustic decoy as defined in claim 5 but further characterized by said casing having a bottom adjacent said spindle means on the end thereof opposite said motor.

* * * * *